US006281682B1

(12) United States Patent
Kameda et al.

(10) Patent No.: US 6,281,682 B1
(45) Date of Patent: Aug. 28, 2001

(54) SENSOR FOR DETECTING IGNITION CURRENT AND ION CURRENT IN IGNITION SECONDARY CIRCUIT

(75) Inventors: Hiroyuki Kameda, Aichi; Yoshihiro Matsubara, Mie, both of (JP)

(73) Assignee: NGK Spark Plug Co., Ltd., Nogoya (JP)

( * ) Notice: Subject to any disclaimer, the term of this patent is extended or adjusted under 35 U.S.C. 154(b) by 0 days.

(21) Appl. No.: 09/320,444

(22) Filed: May 27, 1999

(30) Foreign Application Priority Data

May 27, 1998 (JP) ..... 10-146093

(51) Int. Cl.[7] ..... F02P 17/12

(52) U.S. Cl. ..... 324/391; 324/388; 324/390; 324/393

(58) Field of Search ..... 324/378, 388, 324/390, 391, 393

(56) References Cited

U.S. PATENT DOCUMENTS 4,547,734 * 10/1985 Spaude ..... 324/395
5,237,278 * 8/1993 Bumen ..... 324/388
5,493,227 * 2/1996 Shimasaki et al. ..... 324/378

FOREIGN PATENT DOCUMENTS 4-308362 10/1992 (JP) ..... F02P/17/00

* cited by examiner

*Primary Examiner*—Glenn W. Brown
(74) *Attorney, Agent, or Firm*—Sughrue, Mion, Zinn, Macpeak & Seas, PLLC

(57) ABSTRACT

An ignition secondary sensor is provided which is disposed in a high voltage path between an ignition coil and a spark plug for use with a detecting circuit for detecting ignition current and ion current flowing through a spark plug. The sensor comprises an ignition path connected in series with the high voltage path and having a pair of reverse current preventing diodes and a detection path connected to a spark plug side end portion of the ignition path and having a pair of current detecting diodes. A path portion of the detection path on the side of the current detecting diodes opposite to the ignition path and a path portion of the ignition path connecting between the reverse current preventing diodes are capacitively coupled. The detecting circuit is connected to the sensor for detecting the ignition current (ignition timing) on the basis of current flowing into the sensor therefrom and the ion current (combustion timing) on the basis of current flowing from the sensor thereinto.

17 Claims, 4 Drawing Sheets

SENSOR FOR DETECTING IGNITION CURRENT AND ION CURRENT IN IGNITION SECONDARY CIRCUIT

BACKGROUND OF THE INVENTION

1. Field of the Invention

The present invention relates in general to ignition systems for internal combustion engines and more particularly to an ignition secondary circuit sensor for detecting both of ignition current flowing through a spark plug of an ignition system at the time of spark discharge of the spark plug and ion current flowing through the spark plug at the time of combustion of fuel in a cylinder of the engine. The present invention further relates to a device for detecting an ignition timing and a combustion timing of an internal combustion engine by the use of the above described ignition secondary circuit sensor. The present invention further relates to an apparatus for detecting pre-ignition of an internal combustion engine on the basis of an ignition timing and a combustion timing detected by the above described ignition timing-and-combustion timing detecting device.

2. Description of the Related Art

The above described ignition secondary circuit sensor is known as for example disclosed in Japanese patent provisional publication No. 4-308362. The sensor has a detection path connected to a detecting circuit. The detection path is capacitively coupled with a high voltage path of an ignition system so that the sensor can detect ignition current flowing through the high voltage path in addition to ion current. Due to this, after spark discharge of a spark plug, reverse current which flows through the high voltage path in the reverse direction to the ignition current is caused to flow into the detecting circuit by way of a capacitive coupling portion, thus causing a problem that the detecting circuit erroneously judges the reverse current as ion current.

Namely, at the time of spark discharge of the spark plug, ignition current flows through the high voltage path in one direction, i.e., from the spark plug to an ignition circuit side. Thereafter, by an energy stored in a secondary winding of an ignition coil, reverse current is caused to flow through the high voltage path in the reverse direction to the ignition current. Then, currents in one and the other directions flow through the high voltage path alternately until the energy stored in the secondary winding of the ignition coil is discharged completely. The detecting circuit erroneously judges the current flowing through the high voltage path in the reverse direction to the ignition current as ion current.

Another problem is that erroneous detection of an ignition timing and ion current results from noise or the like since the noise caused on the ignition secondary circuit side of the ignition system is inputted to the detecting circuit by way of the capacitive coupling portion.

SUMMARY OF THE ONE INVENTION

Accordingly, the present invention is intended to overcome the above-mentioned problems encountered with the known ignition secondary circuit sensor.

An object of the present invention is to provide a novel and improved ignition secondary circuit sensor of the type which is operative to detect by itself both of ignition current at the time of spark discharge of a spark plug and ion current at the time of combustion of fuel, which can detect the ignition current and the ion current accurately without being affected by noise caused in an ignition secondary circuit and reverse current flowing through the ignition secondary circuit after spark discharge of the spark plug.

Another object of the present invention is to provide a device for detecting an ignition timing and combustion timing of an internal combustion engine by the use of the ignition secondary circuit sensor of the foregoing character, which can detect the ignition timing and combustion timing accurately.

A further object of the present invention is to provide an apparatus for detecting pre-ignition of an internal combustion engine by the use of the ignition timing-and-combustion timing detecting device of the foregoing character, which can detect the pre-ignition accurately.

In order to achieve the above objects, according to one aspect of the present invention, there is provided a sensor for detecting ignition current flowing through a spark plug of an internal combustion engine at the time of spark discharge of the spark plug and ion current flowing through the spark plug at the time of combustion of fuel in a cylinder of the engine. The engine has an ignition system including a high voltage path connecting between an ignition coil and the spark plug. The sensor comprises an ignition path connected in series to the high voltage path and having at least two reverse current preventing diodes for permitting current to flow through the high voltage path only in one direction, and a detection path having at least one current detecting diode connected at an electrode to that same polarity electrode of one of the reverse current preventing diodes closer to the spark plug (e.g., an anode of the current detecting diode is connected to an anode of the reverse current preventing diode or a cathode of the current detecting diode is connected to a cathode of the reverse current preventing diode), for detecting the ignition current and the ion current by way of the current detecting diode, wherein a path portion of the detection path on the side of the current detecting diode opposite to the ignition path and a path portion of the ignition path connecting between the reverse current preventing diodes are capacitively coupled.

According to another aspect of the present invention, there is provided a device for detecting an ignition timing at which ignition current flows through a spark plug of an ignition system of an internal combustion engine and a combustion timing at which ion current flows through the spark plug. The device comprises a sensor for detecting ignition current and ion current flowing through the spark plug, which is structured substantially the same as that described as above. The device further comprises a capacitor connected at one of opposite ends thereof to an end of the path portion of the detection path which is located on the side of the coupling portion opposite to the current detecting diode, a charging circuit for supplying the capacitor by way of the detection path with an electric charge for causing ion current to flow through the spark plug, a pair of detecting circuit diodes connected at an anode and a cathode to the other of the ends of the capacitor, respectively, and an ignition current detecting circuit and an ion current detecting circuit connected to electrodes of the detecting circuit diodes other than the above-mentioned anode and cathode thereof for detecting the ignition current and the ion current, respectively.

According to a further aspect of the present invention, there is provided an apparatus for detecting pre-ignition of an internal combustion engine. The apparatus comprises a device for detecting an ignition timing and a combustion timing described as above. The apparatus further comprises a judgment circuit responsive to a signal from the ignition current detecting circuit and a signal from the ion current detecting circuit, for judging, in timed relation to an ignition timing at which the ignition current is detected by the ignition current detecting circuit, whether the ion current is detected by the ion current detecting circuit before the ignition timing. The judgment circuit outputs a signal indicating occurrence of pre-ignition in the engine at the time it judges that the ion current is detected before the ignition timing.

DETAILED DESCRIPTION OF THE PREFERRED EMBODIMENTS

Figure 1:
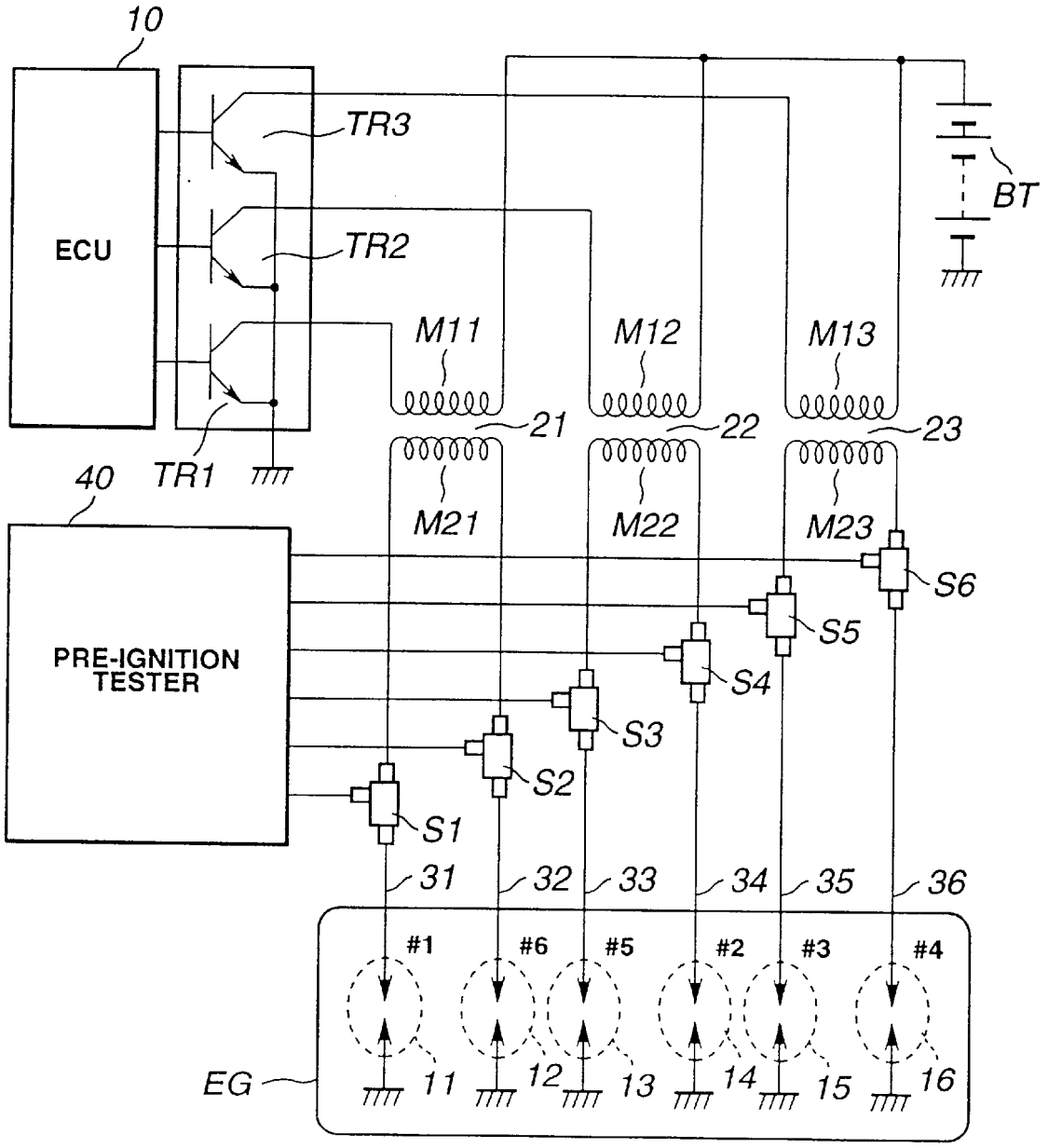
FIG. 1 is a schematic diagram of an ignition system for a six-cylinder internal combustion engine incorporating a pre-ignition detecting apparatus according to an embodiment of the present invention.

Referring first to FIG. 1, an ignition system to which the present invention is applied is of the double-ended distributorless type for use with a six-cylinder four-stroke cycle internal combustion engine.

As shown in FIG. 1, since the ignition system is of the double-ended distributorless type, it is provided with three ignition coils, i.e., an ignition coil 21 for spark plugs 11 and 12, ignition coil 22 for spark plugs 13 and 14 and ignition coil 23 for spark plugs 15 and 16. The pairs of spark plugs 11 and 12, 13 and 14, 15 and 16 are provided to the respective sets of cylinders #1 and #6, #5 and #2, #3 and #4. The cylinders of each set differ in ignition timing by one revolution of the engine EG, i.e., by an angle of 360 degrees. The ignition coils 21, 22 and 23 are so arranged as to apply a positive ignition high voltage and a negative ignition high voltage to each of the sets of spark plugs 11 and 12, 13 and 14, 15 and 16, respectively and simultaneously.

The ignition coils 21, 22 and 23 have primary windings M11, M12 and M13 which are connected at respective first ends to a positive terminal of a battery BT whose negative terminal is grounded. The primary windings M11, M12 and M13 are connected at second ends to collectors of power transistors TR1, TR2 and TR3, respectively. Each power transistor is made up of an NPN transistor and is grounded at its emitter. The power transistors TR1, TR2 and TR3 are turned on or off in response to a signal produced by an engine control unit 10 in timed relation to revolution of the engine EG.

Secondary windings M21, M22 and M23 of the ignition coils 21, 22 and 23 are respectively connected at opposite ends to central electrodes of the corresponding pairs of spark plugs 11–16 by way of high tension cords 31, 32, 33, 34, 35 and 36 which serve as high voltage paths for ignition of each cylinder. The high tension cords 31–36 are provided with ignition secondary circuit sensors S1, S2, S3, S4, S5 and S6, respectively.

The ignition secondary circuit sensors S1–S6 are adapted to detect ignition current and ion current flowing through the spark plugs 11–16 and have terminals connected to a pre-ignition tester 40.

The pre-ignition tester 40 is adapted to detect pre-ignition caused in the respective cylinders #1-#6 at the time of adjustment of the engine EG or the like by using the ignition secondary circuit sensors S1–S6. The detecting result by the pre-ignition tester 40 is used for adjusting the performance characteristics of the engine EG by means of an engine control unit (ECU) 10 or the like so that pre-ignition is not caused.

Description will now be made to the structures of the ignition secondary circuit sensors S1–S6 and the pre-ignition tester 40. For brevity, description will be made by taking; the ignition secondary circuit sensor (hereinafter referred to simply as sensor) S1 and a No. 1 cylinder detecting circuit 41 of the pre-ignition tester 40 for detecting pre-ignition caused in the No. 1 cylinder #1 as an example. The sensor S1 is provided to the high tension cord 31 for applying a negative high voltage which is produced at one terminal of the secondary winding M21 of the ignition coil 21 at the time the power transistor TR1 is turned off, to the central electrode of the spark plug 11 of the No. 1 cylinder #1 and thereby causing the spark plug 11 to spark.

Figure 2:
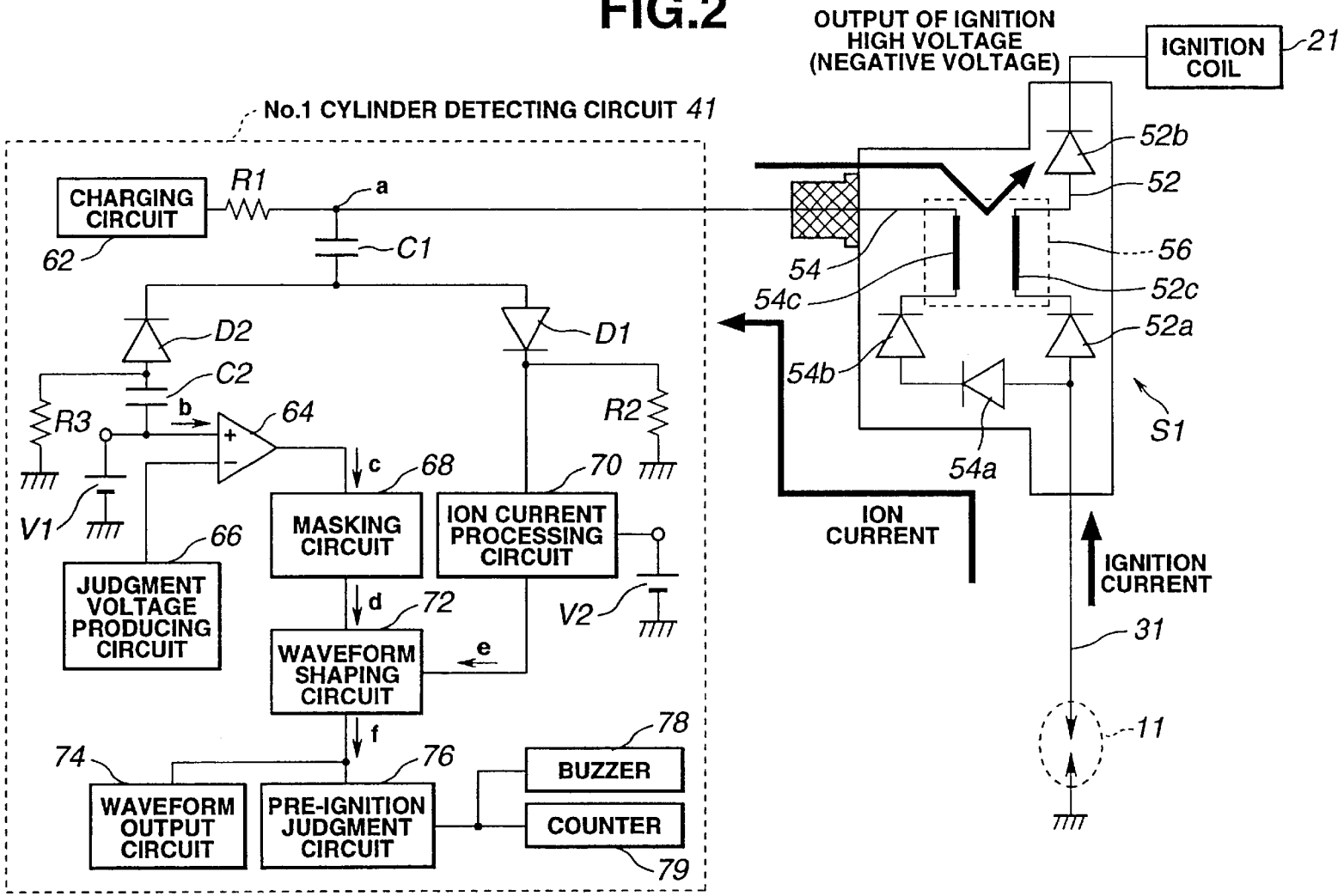
FIG. 2 is a schematic diagram of an ignition secondary circuit sensor and detecting circuit of the pre-ignition detecting apparatus of FIG. 1.

As shown in FIG. 2, the sensor S1 consists of an ignition path 52 connected in series to the high tension cord or high voltage path 31 for thereby allowing ignition current to flow therethrough and a detection path 54 connected at one end to a spark plug 11 side end of the ignition path 52 and at the other end to the No. 1 cylinder detecting circuit 41.

The ignition path 52 is provided with two reverse current preventing diodes 52*a* and 52*b* for allowing ignition current due to negative high voltage induced in the ignition coil 21 to flow in the direction from the spark plug 11 to the ignition coil 21 and preventing current to flow in the reverse direction to that ignition current. The diodes 52*a* and 52*b* are connected in series in such a manner that each cathode is positioned on the ignition coil 21 side and each anode is positioned on the spark plug 11 side.

The ignition path 52 has a path portion connecting between the diodes 52*a* and 52*b*, and the detection path 54 has a path portion located closer to the No. 1 cylinder detecting circuit 41 than the diodes 54*a* and 54*b*. The path portions are respectively provided with metal plates 52*c* and 54*c* and capacitively coupled by disposing the plates 52*c* and 54*c* adjacently in parallel to each other. By this, the sensor S1 is provided with a capacitive coupling portion 56. The capacitive coupling portion 56 and the paths 52 and 54 respectively provided with the diodes 52*a* and 52*b*, 54*a* and 54*b* are embedded in a molded insulation resinous block and thereby formed into an integral unit. The insulation resinous block is preferably made of such a resinous material that has the dielectric strength of 15kV/mm. In the meantime, the diodes 54*a* and 54*b* need to be disposed closer to the ignition path 52 than the capacitive coupling portion 56. If not, current toward the No. 1 cylinder detecting circuit 41 is blocked by the diodes 54*a* and 54*b* even if the current is caused by the voltage induced in the capacitive coupling portion 56 when ignition current flows through the ignition path 52.

The No. 1 cylinder detecting circuit 41 is provided with a capacitor C1 connected at one end to the detection path 54 of the sensor S1. To the junction between the capacitor C1 and the detection path 54 is connected, by way of a resistor R1, a charging circuit 62 for applying a negative high voltage for ion current detection (e.g., 300V on the basis of earth potential) to the capacitor C1 and thereby charging it.

To the other end of the capacitor C1 are connected an anode of a diode D1 whose cathode is grounded by way of a resistor R2 and a cathode of a diode D2 whose anode is grounded by way of a resistor R3. The diodes D1 and D2 are provided for detecting ignition current and ion current by utilizing the fact that the electric potential at the point "a" located on the sensor S1 side of the capacitor C1, varies when the ignition current or ion current flows through the spark plug 11.

Figure 3:
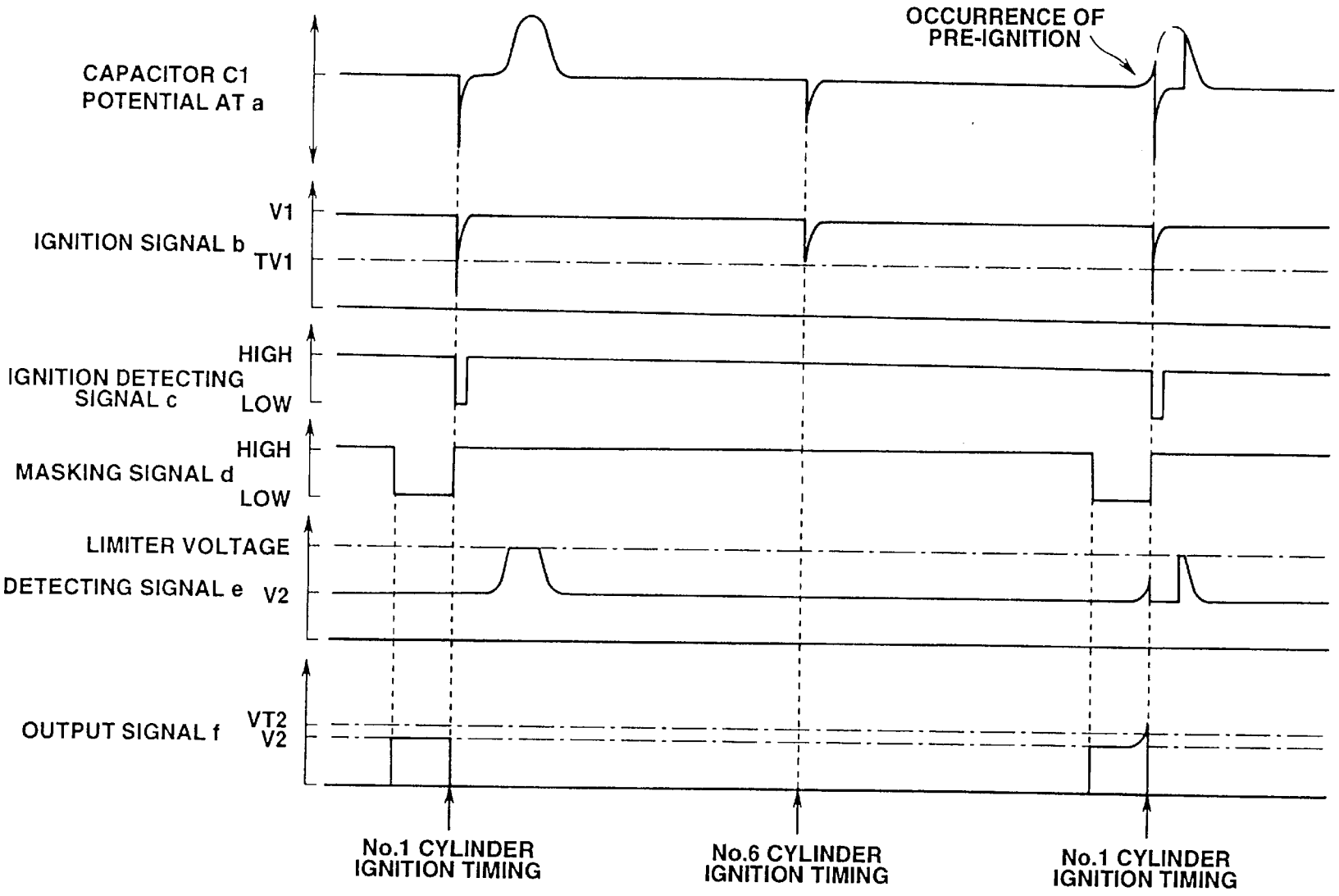
FIG. 3 is a time chart for illustration of the operation of the detecting circuit of FIG. 2.

Namely, as shown in FIG. 3, the potential at "a" on the sensor S1 side of the capacitor C1 increases when ion current flows through the spark plug 11 and decreases when ignition current flows through the spark plug 11, causing the potential on the diode D1, D2 side of the capacitor C1 to vary correspondingly. In response to such a variation of potential, current flows through the diode D1 when ion current flows through the spark plug 11 and through the diode D2 when ignition current flows through the spark plug 11. For this reason, the electric potentials on first sides of the diodes D1 and D2 opposite to the capacitor C1 varies depending upon variations of the ion current and the ignition current, respectively. Thus, it is possible to detect the ion current and ignition current on the basis of variations of the potentials on the first sides of the diodes D1 and D2 opposite to the capacitor C1.

For detecting the ignition current in the above described manner, the anode of the diode D2 is connected by way of the capacitor C2 to a positive polarity (+) side input terminal of a comparator 64 to which a bias voltage Vl (e.g., 10V) is applied. As a result, to the positive polarity (+) side input terminal of the comparator 64 is inputted an ignition signal "b" which is of such a voltage normally equal to the bias voltage V1 and suddenly drops from the bias voltage only when ignition current flows through the spark plug 11 (refer to FIG. 3).

To the negative polarity (−) side input terminal of the comparator 64 is applied from a judgment voltage producing circuit 66 a judgment voltage VT1 (e.g., 5V) for judgment on input of the ignition signal "b". Due to this, from the output terminal of the comparator 64 is outputted an ignition detecting signal "c" which temporarily decreases to a low level when ignition current flows through the spark plug 11 to cause the spark plug 11 to spark (refer to FIG. 3).

The ignition detecting signal "c" outputted by the comparator 64 is inputted to a masking circuit 68. The masking circuit 68 is adapted to find a cycle of spark discharge of the spark plug 11 on the basis of the time period from inputting of the late ignition detecting signal till inputting of the next ignition detecting signal and output a masking signal for setting, on the basis of the cycle found as above, a judgment region for judging whether ion current flows during the time period from the inputting of the late ignition-detected signal till the inputting of the next ignition detecting signal (namely, whether pre-ignition is caused).

Since the ignition system of this embodiment is of the double-ended distributorless type, combustion of fuel within the No. 1 cylinder #1 occurs once for every two times of spark discharge of the spark plug 11, causing ion current to flow through the spark plug 11. However, for detection of pre-ignition, it is not necessary to detect the ion current after the ignition current has flowed through the spark pug 11 but it will suffice to detect the ion current before the ignition current flows through the spark plug 11.

Thus, in this embodiment, the masking circuit 68 is used for setting, within the time period from inputting of a late ignition-detected signal till inputting of a next ignition detecting signal, a time period region during which pre-ignition should be detected on the basis of ion current and generating a masking signal "d" for preventing an ion current detecting signal from being fetched until the time within the time period region (refer to FIG. 3).

On the other hand, to the cathode of the diode D1 is connected an ion current processing circuit 70 for detecting an ion current. The ion current processing circuit 70 produces, when current flows through the diode D1 to cause the cathode side potential to increase, a signal of such voltage equal to the sum of an increased part of the potential and a bias voltage V2 (e.g., 6V) for use as an ion current detecting signal "e" (refer to FIG. 3). In the meantime, although the ion current processing circuit 70 is constituted by a so-called adder, the upper limit of its output is limited by a limiter to a limiter voltage.

Further, the ion current detecting signal "e" from the ion current processing circuit 70 is inputted to a waveform shaping circuit 72 together with the masking signal "d" produced by the masking circuit 68. The waveform shaping circuit 72 produces a signal "f" which is the same as the ion current detecting signal "e" from the ion current processing circuit 70 when the masking signal "d" produced by the masking circuit 68 is not inputted thereto (i.e., when the masking signal "d" is of a low level). The waveform shaping circuit 72 keeps its output at the earth potential when the masking signal produced by the masking circuit 68 is inputted thereto, whereby to stop outputting of the detecting signal "e" (i.e., the masking signal is of a high level).

As a result, the waveform shaping circuit 72 outputs the detecting signal "f" which is of the same voltage level as the detecting signal "e" during only a predetermined period before ignition current flows through the spark plug 11. The output signal "f" is a square wave of a signal level corresponding to the bias voltage V2 when there is not any ion current having flowed through the spark plug 11 before ignition current flows through the spark plug 11. The output signal "f" has such a waveform that results from addition of a voltage corresponding to the ion current to the square wave when there is an ion current having flowed through the spark plug 11 before ignition current flows through the spark plug 11 (i.e., when pre-ignition is caused). The output signal "f" from the waveform shaping circuit 72 is supplied through a waveform output circuit 74 to an outside monitor such as an oscilloscope and to a pre-ignition judgment circuit 76.

The pre-ignition judgment circuit 76 is adapted to compare the output signal "f" from the waveform shaping circuit 72 with a judgment voltage VT2 for judgment of pre-ignition which is previously set to be higher than the bias voltage V2. When the ion current detecting signal "e" exceeds the judgement voltage VT2, the pre-ignition judgment circuit 76 judges that pre-ignition is caused in the No.1 cylinder #1 and outputs a pre-ignition detecting signal to a buzzer 78 and a counter 79.

As a result, when pre-ignition is caused in the No. 1 cylinder #1, a warning sound for warning occurrence of pre-ignition is produced by the buzzer 78 and the number of times of occurrence of pre-ignition is counted by the counter 79.

In the foregoing, it is to be noted that the ignition secondary circuit S1 is made up of the ignition path 52 having the pair of reverse current preventing diodes **52*a* and 52*b* and the detection path 54 having the current detecting diodes 54*a* and 54*b*. The current detecting diodes 52*a* and 52*b* are arranged so that ion current flows through the spark plug 11 in the same direction as ignition current. Furthermore, the path portion of the ignition path 52 between the reverse current preventing diodes 52*a* and 52*b* and the open end side path portion of the detection path 54 (i.e., the path portion of the detection path 54 on the side of the current detecting diodes 54*a* and 54*b* opposite to the ignition path 52) are capacitively coupled. By this, the No. 1 cylinder detecting circuit 41 can detect ignition current on the basis of current flowing from the No. 1 cylinder detecting circuit 41 into the sensor S1 side and ion current on the basis of current flowing from the sensor S1 side into the No. 1 cylinder detecting circuit 41. That is, the direction of the ion current through the detection path 54 and the direction of the current through the detection path 54 due to the voltage induced in the coupling portion 56 are different. More specifically, since a high voltage is applied from the No. 1 cylinder detecting circuit 41 to the detection path 54, ion current flows through the spark plug 11 and therefore through the detection path 54 at the time of combustion of fuel. By detecting the ion current by means of the No. 1 cylinder detecting circuit 41, the combustion condition of the No. 1 cylinder #1 can be detected. Further, at the time of spark discharge of the spark plug 11, a voltage is induced in the detection path 54. Thus, by detecting the current flowing out of the No. 1 cylinder detecting circuit 41 due to the voltage induced in the capacitive coupling portion 56**, the ignition timing can be detected.

Thus, the No. 1 cylinder detecting circuit 41 can detect the ignition current and ion current having flowed through the spark plug 11 by using the pair of diodes D1 and D2, and it becomes possible to make a judgment on occurrence of pre-ignition on the basis of the time the ignition current is detected and the time the ion current is detected, with ease.

Particularly, in this embodiment, the reverse current preventing diodes 52*a* and 52*b* are provided on the opposite sides of the capacitive coupling portion 56 so as to prevent current from flowing through the ignition path 52 in the reverse direction to the ignition current, i.e., so as to permit current to flow through the ignition path 52 only in one direction. By this, it becomes possible to prevent current in the same direction as ion current from being caused by reverse current and flowing from the sensor S1 into the No. 1 cylinder detecting circuit 41 side. This makes it possible to prevent erroneous detection of ion current on the No. 1 cylinder detecting circuit 41 side and therefore erroneous detection of combustion of fuel in the No. 1 cylinder and improve the detection accuracy of ion current.

An embodiment of the present invention have been described and shown as above by way of example with reference to the ignition secondary circuit sensor S1 provided to the high voltage path or high tension cord 31 for applying negative ignition high voltage produced in the secondary winding M21 to the spark plug 11 of the No. 1 cylinder #1 and the No. 1 cylinder detecting circuit 41 for detecting pre-ignition in the No. 1 cylinder #1 by using the sensor S1. Other ignition secondary circuits S2–S6 and their corresponding respective cylinder detecting circuits within the pre-ignition tester 40 can be structured nearly the same as the above described sensor S1 and No. 1 cylinder detecting circuit 41.

Namely, the ignition secondary circuit sensors S3 and S5 provided to the high tension cords 33 and 35 for applying negative ignition high voltage produced in the secondary windings M22 and M23 of the ignition coils 22 and 23 to the spark plugs 13 and 15 of the No. 5 cylinder #5 and No. 3 cylinder #3 and the detecting circuits within the pre-ignition tester 40 for detecting pre-ignition of the No. 5 cylinder #5 and No. 3 cylinder #3 can be structured exactly the same as the above described sensor S1 and No. 1 cylinder detecting circuit 41.

Figure 4A:
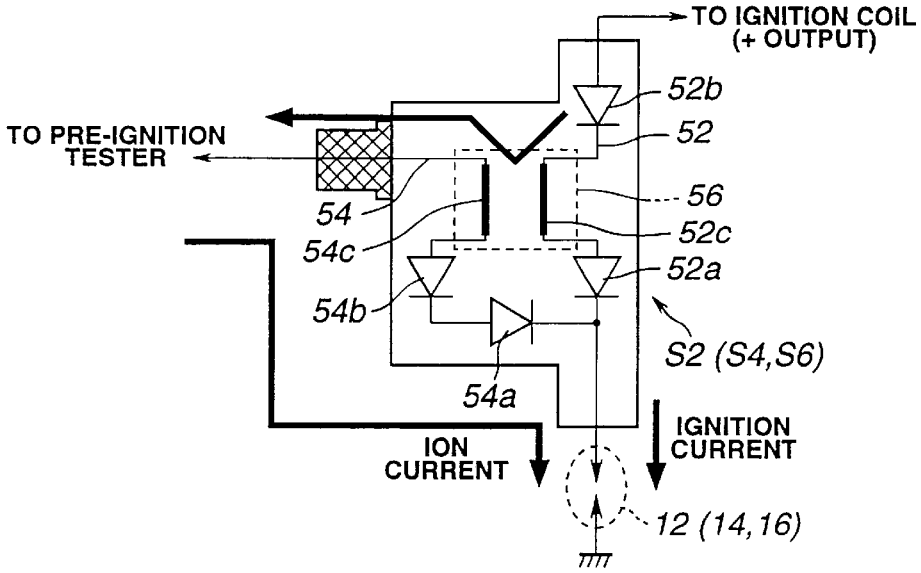
FIGS. 4A to 4C are schematic diagrams of modifications of the ignition secondary circuit sensor of FIG. 2.

On the other hand, in the ignition secondary circuit sensors S2, S4 and S6 provided to the high tension cords 32, 34 and 36 for applying positive ignition high voltage produced in the secondary windings M21–M23 of the ignition coils 21–23 to the spark plugs 12, 14 and 16 of the No. 6 cylinder #6, No. 2 cylinder #2 and No. 4 cylinder #4, the flow direction of ignition current through the high tension cords 32, 34 and 36 is reverse to that of ignition current through the high tension cord 31. Thus, to correspond to such a direction of current, the diodes 52*a*, 52*b*, 54*a* and 54*b* within the sensors S2, S4 and S6 are arranged, as shown in FIG. 4A, in the directions reverse to the diodes 52*a*, 52*b*, 54*a* and 54*b* within the sensor S1 in FIG. 2, respectively.

Further, the pre-ignition detecting circuits within the pre-ignition tester 40 for detecting pre-ignition in the above described cylinders #6, #2 and #4 by using the respective sensors S2, S4 and S6 are constructed such that connection of the diodes D1 and D2 is reverse to that of the No. 1 cylinder detecting circuit 41 sown in FIG. 2 and the charging circuit 62 produces positive high voltage (e.g., +300V).

Fram the foregoing, it will be understood that the No. 1 cylinder detecting circuit 41 and other detecting circuits for other cylinders within the pre-ignition tester 40 cooperate with the sensors S1–S6 to constitute an apparatus for detecting pre-ignition of the engine EG.

It will be further understood that the capacitor C1, the charging circuit 62, the diodes D1 and D2, the resistors R1–R3, the comparator 64, the judgment voltage producing circuit 66 and the ion current processing circuit 70 cooperate with the sensor S1 to constitute a device for detecting an ignition timing and a combustion timing of the No. 1 cylinder #1 of the engine EG.

It will be further understood that the comparator 64 and the ion current processing circuit 70 constitute an ignition current detecting circuit and an ion current detecting circuit of the above described ignition timing-and-carbustion timing detecting device, respectively.

It will be further understood that the masking circuit 68, waveform shaping circuit 72 and pre-ignition judgment circuit 76 constitute a judgment circuit of the above described pre-ignition detecting apparatus.

While the present invention has been described with reference to one embodiment, the present invention is not limited to the embodiment described above. Modifications and variations of the embodiment described above will occur to those skilled in the art in light of the above teachings.

For example, while in the above described embodiment the capacitive coupling portion 56 for capacitively coupling the ignition path 52 and the detection path 54 in the ignition secondary circuit sensor S1 is made up of the flat metal plates 52*c* and 54*c* which are connected to the conductors constituting the respective paths 52 and 54 and which are arranged in parallel to each other, it is not necessary for the flat metal plates 52*c* and 54*c* to be disposed accurately in parallel to each other but nearly in parallel since it will suffice that the paths 52 and 54 are capacitively coupled. Further, the distance between the plates is set so that the capacitive coupling portion 56 has the capacity of 0.2 pF or more and the dielectric strength of 30 kV or more.

Figure 4B:
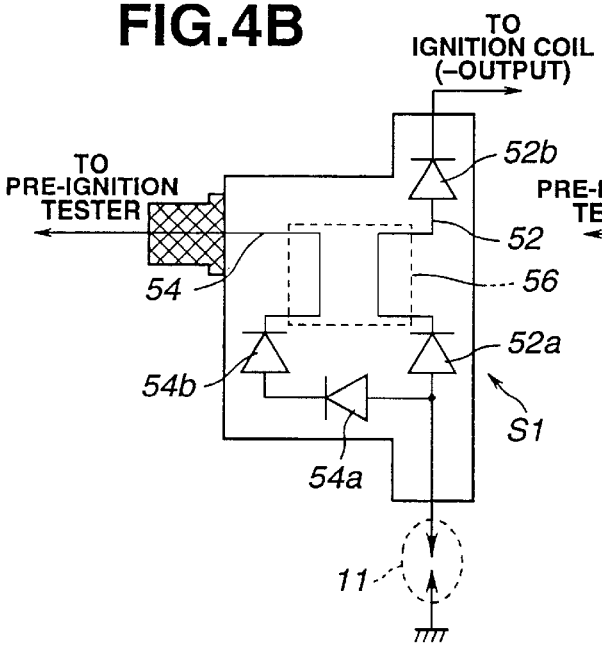
Figure 4C:
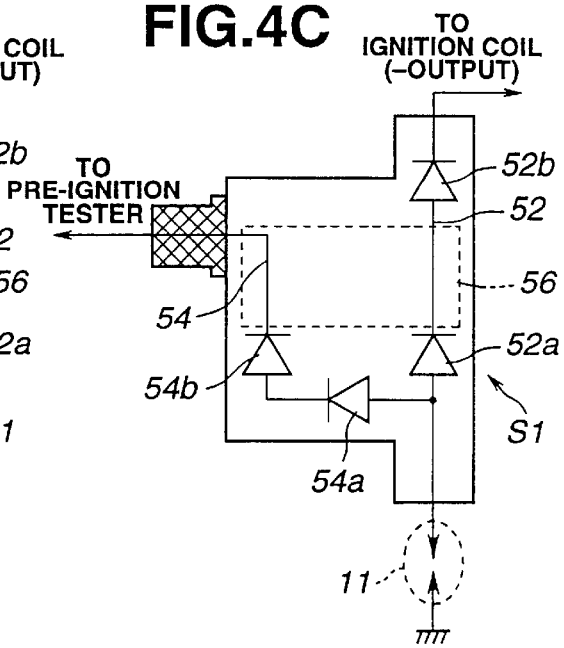

Further, if the capacitive coupling portion 56 can retain the capacity of 0.2 pF or more and the dielectric strength of 30 kV or more, it is not necessary to provide the flat metal plates 52*c* and 54*c* to the respective paths 52 and 54 but it will suffice only to dispose the conductors constituting the paths 52 and 54 in parallel to each other as shown in FIGS. 4B and 4C.

What is claimed is:

1. A sensor for detecting ignition current flowing through a spark plug of an internal combustion engine at the time of spark discharge of the spark plug and ion current flowing though the spark plug at the time of combustion of fuel in a cylinder of the engine, the engine having an ignition system with a high voltage path between an ignition coil and the spark plug, the sensor comprising:

an ignition path connected in series with said high voltage path and having at least two reverse current preventing diodes for permitting current to flow through said high voltage path only in one direction; and a detection path having a first current detecting diode connected at an electrode to that same polarity electrode of one of said reverse current preventing diodes closer to said spark plug, for detecting said ignition current and said ion current by way of said first current detecting diode;

wherein a path portion of said detection path on the side of said first current detecting diode opposite to said ignition path and a path portion of said ignition path connecting between said reverse current preventing diodes are capacitively coupled.

2. A sensor according to claim 1, further comprising a molded, insulating resinous block in which said path portion of said detection path and said path portion of said ignition path are embedded.

3. A sensor according to claim 1, wherein said path portion of said detection path and said path portion of said ignition path comprise respective conductors which are disposed adjacent to each other.

4. A sensor according to claim 1, said path portion of said detection path and said path portion of said ignition path comprise conductors and parallel flat metal plates connected to said conductors, respectively.

5. A sensor according to claim 1, wherein said detection path further comprises a second current detecting diode disposed between said first current detecting diode and said path portion of said detection path, said first current detecting diode and said second mentioned current detecting diode being connected in series with each other at electrodes of different polarities.

6. A device for detecting an ignition timing at which ignition current flows through a spark plug of an ignition system of an internal combustion engine and a combustion timing at which ion current flows through the spark plug, the ignition system having a high voltage path connecting between an ignition coil and the spark plug, the device comprising:

a sensor of claim 1;

a capacitor connected at one of opposite ends thereof to an end of said path portion of said detection path which is located on the side of a coupling portion opposite to said first current detecting diode;

a charging circuit for supplying said capacitor by way of said detection path with an electric charge for causing ion current to flow through said spark plug;

a pair of detecting circuit diodes connected at an anode and a cathode to the other of said ends of said capacitor, respectively; and an ignition current detecting circuit and an ion current detecting circuit connected to electrodes of said detecting circuit diodes other than said anode and said cathode thereof for detecting said ignition current and said ion current, respectively.

7. An apparatus for detecting pre-ignition of an internal combustion engine, said apparatus comprising:

a device of claim 6; and a judgment circuit responsive to a signal from said ignition current detecting circuit and a signal from said ion current detecting circuit, for judging, in timed relation to an ignition timing at which said ignition current is detected by said ignition current detecting circuit, whether said ion current is detected by said ion current detecting circuit before said ignition timing;

said judgment circuit outputting a signal indicating occurrence of pre-ignition in the engine at the time it judges that said ion current is detected before said ignition timing.

8. In an ignition system for an internal combustion engine, having an ignition coil, a spark plug and a high voltage path connecting between the ignition coil and the spark plug, an ignition secondary circuit sensor for detecting ignition current flowing through a spark plug of the engine at the time of spark discharge of the spark plug and ion current flowing through the spark plug at the time of combustion of fuel in a cylinder of the engine, the sensor comprising:

an ignition path for connection in series with said high voltage path and having at least two reverse current preventing diodes for permitting current to flow through said high voltage path only in one direction; and a detection path branching off from said ignition path and having a first current detecting diode connected at an electrode to that same polarity electrode of one of said reverse current preventing diodes closer to said spark plug;

wherein a path portion of said detection path on the side of said first current detecting diode opposite to said ignition path and a path portion of said ignition path connecting between said reverse current preventing diodes are capacitively coupled.

9. An ignition secondary circuit sensor according to claim 8, further comprising a molded, insulating resinous block in which said path portion of said detection path and said path portion of said ignition path are embedded.

10. An ignition secondary circuit sensor according to claim 8, wherein said path portion of said detection path and said path portion of said ignition path comprise respective conductors which are disposed adjacent to each other.

11. An ignition secondary circuit sensor according to claim 8, said path portion of said detection path and said path portion of said ignition path comprise conductors and parallel flat metal plates connected to said conductors, respectively.

12. An ignition secondary circuit sensor according to claim 8, wherein said detection path further comprises a second current detecting diode disposed between said first current detecting diode and said path portion of said detection path, said first current detecting diode and said second current detecting diode being connected in series with each other at electrodes of different polarities.

13. In an ignition system for an internal combustion engine, having a secondary winding of an ignition coil, a spark plug and a high voltage path connecting between the secondary winding and the spark plug, a combination of:

an ignition secondary circuit sensor for detecting ignition current flowing through a spark plug of the engine at the time of spark discharge of the spark plug and ion current flowing through the spark plug at the time of combustion of fuel in a cylinder of the engine, the ignition secondary circuit sensor comprising an ignition path for connection in series with said high voltage path and having at least two reverse current preventing diodes for permitting current to flow through said high voltage path only in one direction, and a detection path branching off from said ignition path and having a first current detecting diode connected at an electrode to that same polarity electrode of one of said reverse current preventing diodes closer to said spark plug, wherein a path portion of said detection path on the side of said first current detecting diode opposite to said ignition path and a path portion of said ignition path connecting between said reverse current preventing diodes are capacitively coupled; and a detecting circuit connected to said detection path for detecting said ignition current and said ion current on the basis of current flowing through said detection path.

14. A combination according to claim 13, wherein said sensor further comprises a molded, insulating resinous block in which said path portion of said detection path and said path portion of said ignition path are embedded.

15. A combination according to claim 13, wherein said path portion of said detection path and said path portion of said ignition path comprise respective conductors which are disposed adjacent to each other.

16. A combination according to claim 13, wherein said path portion of said detection path and said path portion of said ignition path comprise conductors and parallel flat metal plates connected to said conductors, respectively.

17. A combination according to claim 13, wherein said detection path further comprises a second current detecting diode disposed between said first current detecting diode and said path portion of said detection path, said first current detecting diode and said second current detecting diode being connected in series with each other at electrodes of different polarities.

* * * * *